US008456111B2

(12) United States Patent
Busch

(10) Patent No.: US 8,456,111 B2
(45) Date of Patent: Jun. 4, 2013

(54) LINEAR DRIVE FOR SLIDING DOORS OR THE LIKE

(75) Inventor: Sven Busch, Dortmund (DE)

(73) Assignee: Dorma GmbH & Co. KG, Ennepetal (DE)

( * ) Notice: Subject to any disclaimer, the term of this patent is extended or adjusted under 35 U.S.C. 154(b) by 360 days.

(21) Appl. No.: 12/673,702

(22) PCT Filed: Jul. 18, 2008

(86) PCT No.: PCT/EP2008/005906

§ 371 (c)(1),
(2), (4) Date: Mar. 25, 2011

(87) PCT Pub. No.: WO2009/021596

PCT Pub. Date: Feb. 19, 2009

(65) Prior Publication Data

US 2011/0190940 A1 Aug. 4, 2011

(30) Foreign Application Priority Data

Aug. 16, 2007 (DE) ..... 10 2007 038 844

(51) Int. Cl.
*F04D 15/00* (2006.01)

(52) U.S. Cl.
USPC ..... 318/3; 318/139; 318/600; 318/603; 318/567; 318/636; 310/12; 310/135; 310/51; 310/105

(58) Field of Classification Search
USPC ..... 318/3, 139, 600, 603, 625, 569, 561, 318/567, 608, 636, 652; 310/12, 135, 51, 310/105
See application file for complete search history.

(56) References Cited

U.S. PATENT DOCUMENTS

| | | | | | |
|---|---|---|---|---|---|
| 4,422,027 | A | * | 12/1983 | Mohlere | 318/687 |
| 5,119,004 | A | * | 6/1992 | Sakamoto et al. | 318/569 |
| 5,134,324 | A | * | 7/1992 | Sakagami et al. | 310/12.04 |
| 5,203,112 | A | * | 4/1993 | Yamagishi et al. | 49/280 |
| 5,373,120 | A | * | 12/1994 | Barrett et al. | 187/316 |
| 5,828,195 | A | * | 10/1998 | Zalesski | 318/366 |
| 7,397,212 | B2 | * | 7/2008 | Turner | 318/561 |
| 8,109,040 | B2 | * | 2/2012 | Finke | 49/360 |

FOREIGN PATENT DOCUMENTS

| | | |
|---|---|---|
| DE | 4137201 | 5/1993 |
| EP | 0433830 | 6/1991 |
| EP | 0567897 | 11/1993 |

* cited by examiner

*Primary Examiner* — Walter Benson
*Assistant Examiner* — Jorge L Carrasquillo
(74) *Attorney, Agent, or Firm* — Cozen O'Connor

(57) ABSTRACT

A linear drive based on linear motors, for panels, in particular sliding doors, movable along a respective travel path. A linear drive for at least one panel, in particular a sliding door leaf, movable along a travel path, has at least one linear motor for this at least one panel. The linear motor is provided with a stator member and a carriage. Furthermore, the linear drive has a control circuit. The control circuit is adapted to stop the linear motor in the event of failure of power supply to the linear motor, by switching-off the linear motor and operating it as a generator. Thereupon, in terms of its displaceability, this movable panel is enabled by the control circuit. In addition, the linear drive has a switch for switching-off the energy supply to the at least one linear motor.

21 Claims, 5 Drawing Sheets

LINEAR DRIVE FOR SLIDING DOORS OR THE LIKE

PRIORITY CLAIM

This is a U.S. national stage of application No. PCT/EP2008/005906, filed on Jul. 18, 2008 which claims priority to the German Application No.: 10 2007 038 844.8, filed: Aug. 16, 2007, the content of both incorporated herein by reference.

BACKGROUND OF THE INVENTION

1. Field of the Invention

The invention relates to linear drives, which are based on linear motors, for panels, in particular sliding doors, movable along a respective travel path.

2. Related Art

Sliding doors operated by linear motors are well known. Usually a stator, which essentially consists of a row of interconnected electrical coils, is disposed above a respective sliding door leaf in a stationary part. At a side facing the stator, the respective sliding door leaf is provided with a rotor, which has a row of one of permanent magnets and/magnetizable material.

SUMMARY OF THE INVENTION

An object of invention is to further develop the functionality of linear drives based on linear motors for panels movable along a respective travel path.

An inventive linear drive for at least one panel, in particular a sliding door leaf, movable along a travel path, has at least one linear motor for this at least one panel. The linear motor is provided with a stator member and a carriage. Furthermore, the linear drive has a control circuit. The control circuit is adapted to stop the linear motor in the event of failure of power supply to the linear motor, by switching-off the linear motor and by operating it as a generator. Thereupon, in terms of its displaceability, this movable panel is enabled by the control circuit. In addition, the inventive linear drive has a switch for switching-off the energy supply of the at least one linear motor.

According to one embodiment of the invention, once the energy supply is reapplied, the control circuit is adapted to perform a positioning run of the at least one panel in order to determine at least one limit stop of the at least one panel. This serves the safety of operation of the linear drive and increases the safety for people using an installation equipped with such a linear drive.

It is furthermore preferred that the control circuit is adapted, initially or after activating, to perform a learning run of the at least one panel in order to determine predetermined parameters for driving the at least one panel. The learning run comprises at least one displacement of this at least one panel in a first travel direction and at least one displacement of it in a second direction opposite to the first travel direction, respectively at a minimum travel speed. The minimum travel speed is provided, because it is almost impossible to monitor the closing edges of the movable panel during the learning run.

It is furthermore preferred the linear drive comprises circuitry to adjust a travel speed of the at least one panel, which may consist of a potentiometer, by which the maximum driving energy supplied to the linear motor can be adjusted. Advantageously, the circuitry is adapted to individually adjust travel speeds of the at least one panel in both travel directions. It is thereby possible to complete an opening procedure faster than a closing procedure. The safety during the operation of the movable panel is thereby enhanced.

The control circuit according to the invention is furthermore preferably adapted to switch off the linear motor or to operate it as a generator during a displacement of the at least one panel in a direction opposite to a driving direction of the linear motor and/or at a travel speed, which is different from a driving speed of the linear motor. This is for example the case when the movable panel is moved manually in a direction opposite to a current driving direction of the linear motor. Switching-off serves to protect the linear motor against damages, for example due to higher driving currents, and thus against excessive heating of the linear motor. The generative operation may be provided to indicate to a respective operator that the movable panel should be driven in the opposite direction.

In a preferred embodiment the linear drive has an activator to activate the linear motor to move the at least one panel in a predetermined travel direction. Preferably, the linear motor comprises a displacement sensor, the control circuit being adapted to determine, by signals from the displacement sensor, a movement and a current position of the at least one panel along its travel path. When determining a movement of the at least one panel from a standby condition and a deviation of the current position of the at least one panel from the standby condition, in which a start of the movement of the at least one panel has been detected for the first time, by more than a predetermined minimum measure, according to the invention, the control circuit activates the linear motor such that it moves the at least one panel in a current direction of movement. Preferably, determining the movement and the deviation from the position is limited to terminal positions of the at least one panel. The above described procedure allows an individual for example to give a movable panel, configured as a sliding door leaf, a push in a travel direction. After a predetermined minimum travel path, the control circuit will interpret this action as an intention of the individual to intend to displace the sliding door leaf in this direction, and takes over further driving of the sliding door leaf. Thus an intuitively operable drive has been created. This lends itself to retrofitting operations in which the said individuals do not need to be informed any more about the existing, now automatic drive.

According to one embodiment the invention, the control circuit, by monitoring predetermined parameters, is furthermore preferably adapted to detect a presence of possible obstacles on the travel path of the at least one panel. The parameters may comprise a travel speed of the at least one panel, a position of the at least one panel and/or a driving current of the linear motor driving this panel. This allows for example to detect malfunctioning and to take necessary countermeasures, thus increasing the safety of operation.

The control circuit is furthermore preferably adapted to allow for displacing the at least one panel, independently from the linear motor, i.e. manual displacing up to a predetermined maximum travel speed of the at least one panel. When an excess of the maximum travel speed is determined, the control circuit is able to operate the linear motor in a direction opposite to the current travel direction of the at least one panel, with a predetermined driving force which depends on a measure of excess of the maximum travel speed. This means, the movable panel can only be displaced up to a predetermined maximum speed. This serves to protect rotor rollers against excessive mechanical stress and thus against premature wear or even against damages. Preferably this type of operating the linear motor is performed by switching-off, generative operating and/or driving the linear motor in a direction opposite to the current travel direction of the at least one panel. The possibility is thereby provided to prevent possible excessively high motor currents and to protect the sliding door against damage. In addition, it is possible to slow down the movable panel from a speed in the area of a limit stop to such an extent that a risk of damages is reduced.

The control circuit is furthermore preferably adapted, during a driving operation of the at least one panel when reaching a predetermined braking area with regard to the at least one panel, to drive the linear motor according to a predetermined braking behaviour. Preferably, there are two braking areas, namely respectively in front of a limit stop of the at least one panel. These braking areas serve to safely slow down the movable panel.

The control circuit, in at least one terminal position of the at least one panel, is furthermore preferably adapted to control the linear motor such that the at least one panel, with a predetermined force, is prevented from moving against the movement of the at least one panel out of the respective terminal position. Preferably, this operation is performed by controlling the linear motor in at least one terminal position of the at least one panel such that the panel maintains its position. This serves to prevent the panel from an unwanted movement, for example on account of wind-induced influences.

It is furthermore preferred that the linear drive has a sensor system for monitoring parameters relevant for a smooth operation of the linear drive. These operating parameters comprise for example an operating temperature of the linear motor and/or of the control circuit and/or of a power supply unit of the linear motor. The control circuit, upon detecting that at least one of the operating parameters is outside a predetermined, admissible range, is preferably adapted to control the linear drive in an altered manner. The change may reduce a driving speed of the linear motor, extend an opening or closing stop time with regard to the at least one panel, and/or switch off the linear drive. This will serve the purpose of allowing the linear drive (time wise) to cool down, something that would perhaps not be possible in an otherwise normally continued operation.

BRIEF DESCRIPTION OF DRAWINGS

Further features and advantages of the invention will become apparent from the following description of preferred embodiments, in which.

DETAILED DESCRIPTION OF THE PREFERRED EMBODIMENTS

Figure 1:
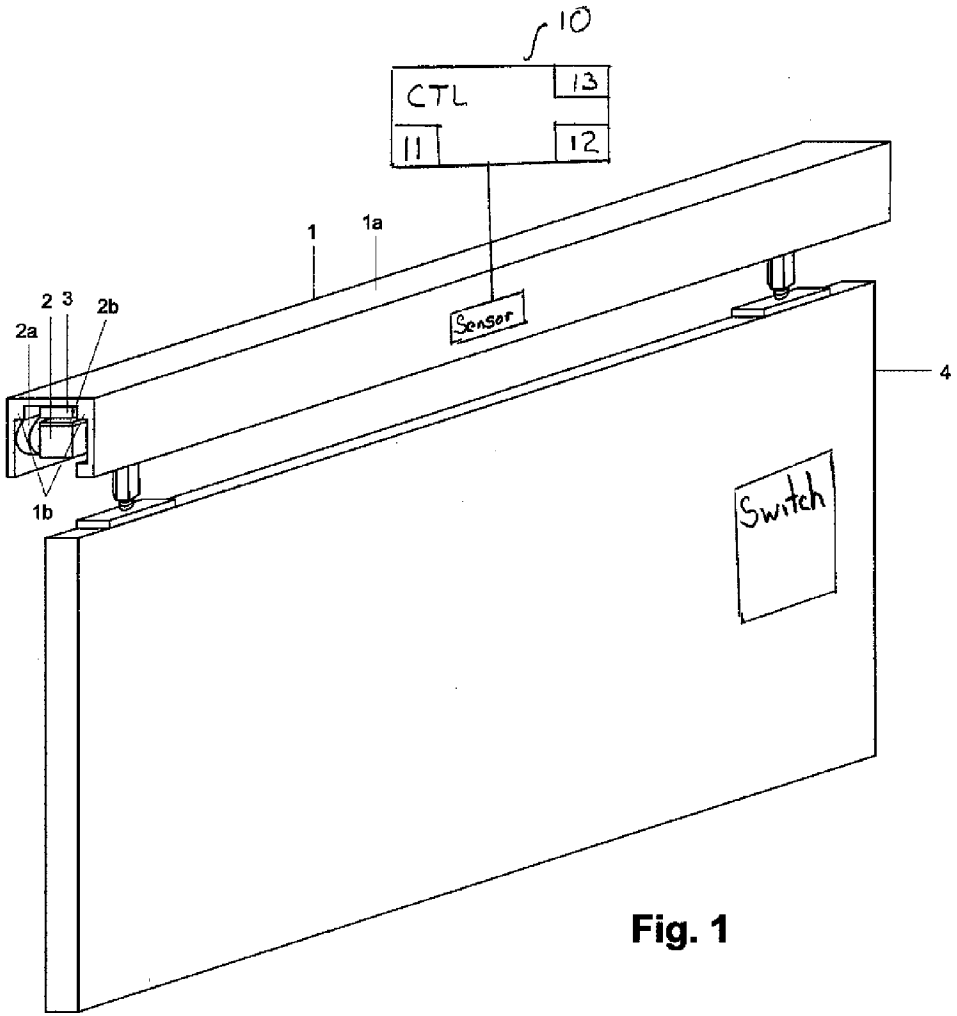
FIG. 1 is a perspective view of a suspension system for a sliding door according to an embodiment of the invention.

The installation shown in FIG. 1 comprises a linear drive 1, which, in the example shown, has a carrying profile 1*a*. At an interior surface of the carrying profile 1*a*, pointing downwards in FIG. 1, guiding rails 1*b* are configured, respectively disposed preferably at both sides in cross-section.

Furthermore, in the example shown, the installation comprises a panel configured as a sliding door leaf 4, movable along a travel path. The travel path is defined by a course of the guiding rails 1*b*.

At the inner side of the carrying profile 1*a*, a stator member 3 is preferably disposed between the guiding rails 1*b*. As an alternative, the guiding rails 1*b* can be formed by the interior surface itself, as long as the latter has a sufficient stability.

Preferably, the stator member 3 has a row of electrical coils extending along at least one portion of the travel path, which are interconnected according to a predetermined control scheme, preferably a 3-phase control scheme. The electrical coils are preferably provided with a keeper made from magnetizable material.

Carriages 2, by which the sliding door leaf 4 is suspended, are disposed at an underside of the electrical coils in FIG. 1. Each carriage 2, at a side facing the stator member 3, has respectively one rotor, which preferably has a row 2*b* of permanent magnets likewise extending along a portion of the travel path. As an alternative, the respective rotor may be formed by magnetizable material as long as a driving force of the stator member 3 is sufficient to displace or to move the sliding door leaf 4.

Preferably, rollers 2*a* are freely rotatably disposed at the respective carriage 2 and roll on a running surface of one of the guiding rails 1*b*. Furthermore, the carrying profile 1*a* may be provided with additional guiding rails, which are configured to face each other in cross-section at free ends. In this case, additional rollers are disposed to roll on respectively one upwards pointing running surface of one of these additional guiding rails in FIG. 1.

Furthermore, the linear drive comprises a control circuit 10. The control circuit 10 is preferably subdivided into a logic control circuit 11 and a motor control circuit 12.

The logic control circuit 11 forms the control and communications center for the control circuit 10 of the linear drive. Among other things, the logic control circuit 11 is adapted to send travel and test instructions to the motor control circuit 12, as well as to receive status and safety messages. Such status and safety messages comprise for example a temperature of the linear drive, or the speed and position of the sliding door leaf 4. Preferably, external signal generators, such as sensors, radar, and program switches can be connected to the logic control circuit 11.

Preferably hardware components in the form of a power output stage and a controller, preferably in the form of a microcontroller, for example for calculating physical processes, are provided in the motor control circuit 12 for controlling the linear motor 1. The motor control circuit 12 is adapted to commutate the linear motor 1, preferably by generating a 3-phase travel voltage by means of pulse width modulation. Furthermore, it can be adapted to detect a position and speed of the sliding door leaf 4, to control, respectively to regulate travel conditions of the sliding door leaf 4, and/or to perform a speed regulation of the sliding door leaf 4.

The logic and motor control circuits 11, 12 utilize preferably one and the same microcontroller 13, which results in cost savings.

Figure 2:
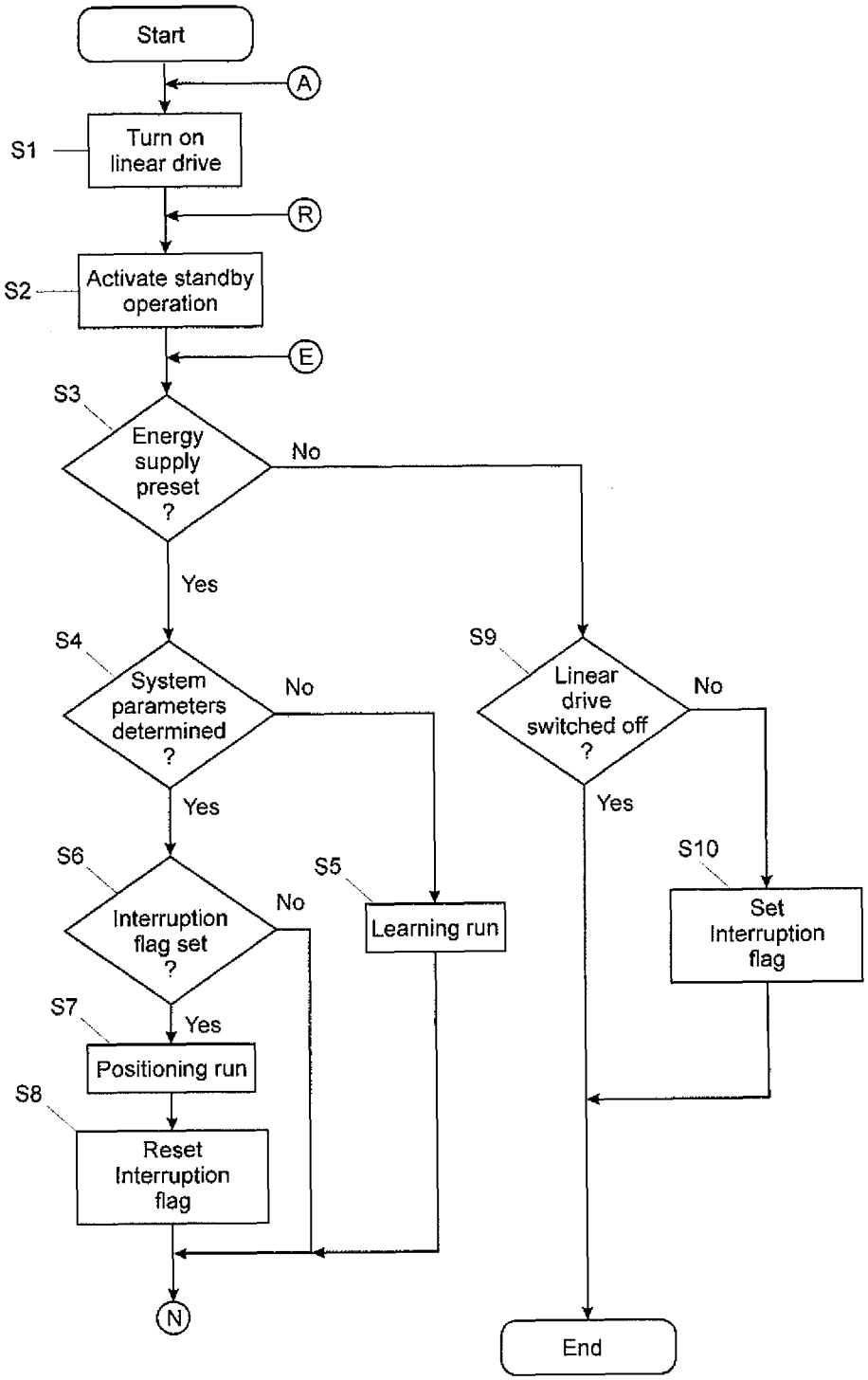
FIG. 2 is a flowchart for operating a suspension system for a sliding door by a linear drive, based on one exemplary linear motor according to an embodiment of the invention.

By way of example, FIG. 2 is a flow diagram depicting a method, respectively a routine for operating one exemplary linear motor. Initially the linear motor, i.e. the linear drive 1 is switched off. This is in particular the case immediately after having the linear drive 1 installed. After switching-on the linear drive 1 (step S1), for example by connecting to a power supply grid, initially the control circuit preferably activates a standby operation of the linear drive 1 (step S2). This standby operation provides maintaining the sliding door leaf 4 in position.

Thereupon, the method tests if (sufficient) energy supply is present (step S3). This is realized for example in that, by the control circuit 10, a voltage applied to it and a current applied to it are measured and compared to reference values to be respected, which are stored in a non-volatile memory of the control circuit. This situation may arise for example, if during the installation procedure a short circuit occurs in the power supply line.

If no energy or only insufficient energy is available, i.e. the linear motor 1 cannot be operated, in a subsequent step S9, it is checked if the linear drive 1 might be still switched off or has been switched off again. The functional branch in FIG. 2 is also intended for the case, if a failure of energy occurred during operation, which has resulted in switching-off the linear drive 1. If the linear drive 1 is switched off, the routine ends here and starts at the beginning by switching-on again. This test may be done by a flag which identifies the on-state of the linear drive 1 and is stored in a non-volatile memory. This means that in the off-state of the linear drive 1, the on-flag is preferably reset, thus has the logic value "0", or "false" and, during switching-on, is set to logic "1", or "true", thus high active. However, a low activity with regard to this flag is possible, such that, during the off-state of the linear drive 1, the on-flag is set, thus has the logic value "1", or "true" and, during switching-on, is set to the logic "0" or "false".

In the following the operation with high active flags will be described. However, if the linear drive 1 is still in an on-state, in step S10, a flag is set preferably in a non-volatile memory, which flag indicates that, during the operation of the linear drive 1, the energy supply has been interrupted or is insufficient.

In order to be able to perform the above tests, preferably a storage for electrical energy is provided, for example in the shape of an accumulator or as a capacitor circuit, on which the memory of the control circuit relies in this case.

If it has been determined in step S3, that sufficient energy supply is provided, it will be determined in a step S4, whether or not the physical parameters for the system's and/or the linear drive, required for a smooth operation of the linear drive 1, have been already determined.

These parameters are preferably stored this time in a volatile memory and are initially set at inadmissible values for example or they are not provided at all. In case the parameters are not yet determined, which is for example the case during initial switching-on of the linear drive 1, a so-called learning run will be performed in a subsequent step S5. In this case, the control circuit of the linear drive 1 operates the one or more linear motor(s) at least respectively once in a first travel direction, for example an opening direction, and once in a second travel direction opposite to the first travel direction, for example the closing direction, and thus performs preferably respectively at least one opening and one closing run of the sliding door leaf 4. The control circuit prompts the one or more linear motor(s) to displace the corresponding sliding door leaf 4 at a preferred minimum travel speed and with preferred minimum driving forces. An internal obstacle detection is preferably deactivated during this phase. In this case, the first travel direction is preferably leading away from the control circuit and, according to the invention, it is performed once after installing the linear drive 1.

Furthermore, it may be intended to be able to manually effect the learning run additionally by means of actuating a special switch coupled to the control circuit, for example a reset switch. This may be useful for example when the sliding door leaf 4 is exchanged for another sliding door leaf which has a different weight. In this case, at least the driving forces change, which the respective linear motor needs to generate. Once the learning run is completed, the control circuit switches to a so-called normal operation, i.e. to an automatic driving of the linear drive 1 (branching point Ⓝ).

If the said physical parameters for the system drive and/or linear drive have been already determined Ⓝ (YES-branch following step S4), it is checked in a subsequent step S6, whether or not the above described interruption flag is set, i.e. whether or not, immediately before occurrence of the presence of sufficient energy supply, an interruption or failure of energy supply happened. If, in case of a high activity, the flag is not set, i.e. if it has the logic value "0" or "false", the linear drive 1 can be normally operated and the control circuit switches back again to the normal operation (branching point Ⓝ).

If, however in step S6, the interruption flag is set, a so-called positioning run is performed in the following step S7. In this case, the control circuit controls the linear motor such that it initially displaces the sliding door leaf 4 at a preferred minimum speed in the opening direction up to a predetermined limit stop, i.e. an open position. Thereupon the linear motor is controlled such as to displace the respective sliding door leaf 4 at a predetermined, preferably adjustable normal closing speed in the closing direction. As an alternative, a current position may be determined via Hall sensors, present in the stator member 3 and, on account of a limit stop information stored in a non-volatile memory, the sliding door leaf 4 can be displaced to shut, unless the sliding door leaf 4 is already closed.

After a successful positioning run, the interruption flag is reset, and the control circuit switches back to normal operation (branching point Ⓝ).

Figure 3:
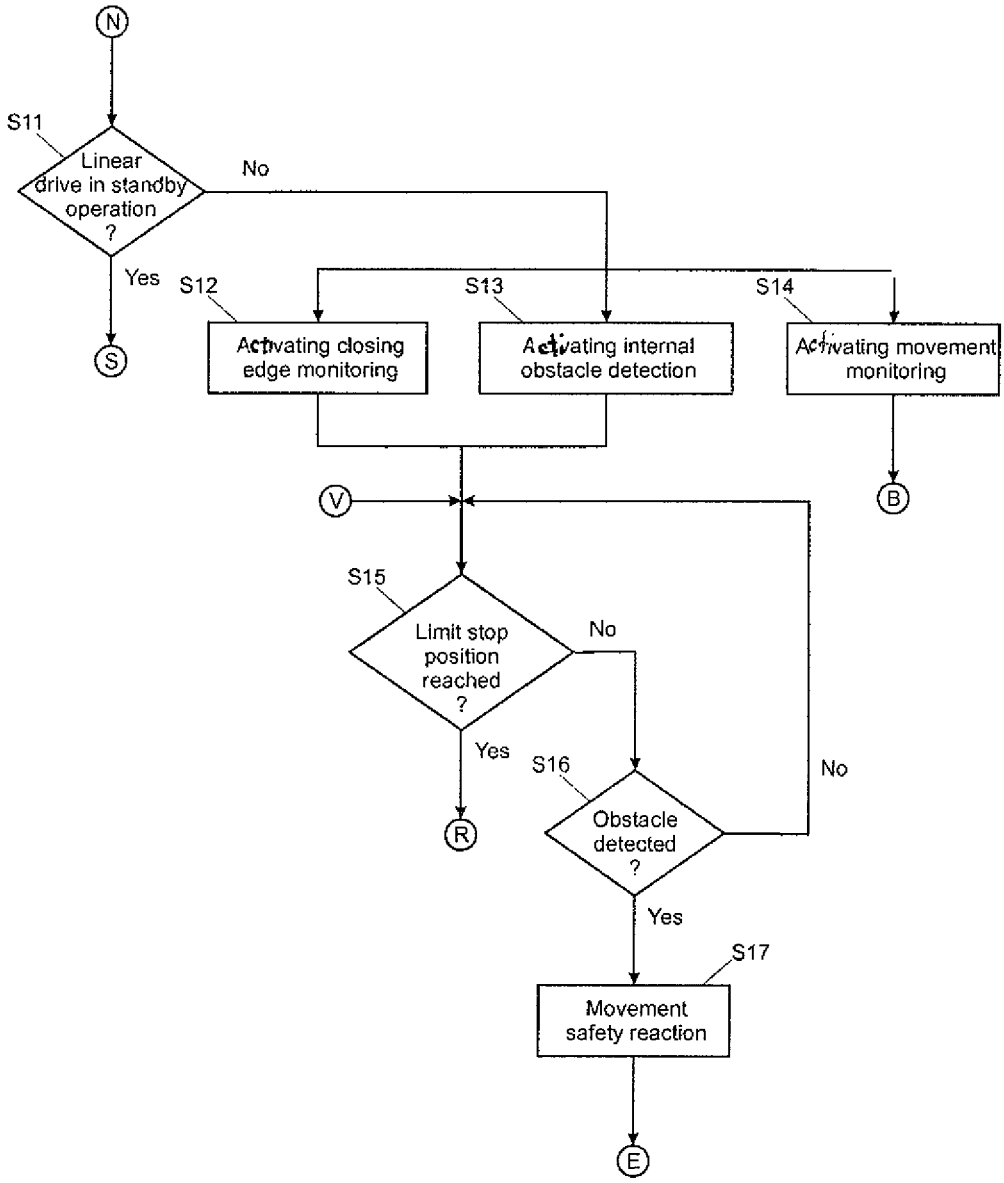
FIG. 3 is a flowchart for normal operation of the linear drive within the framework of the method illustrated in FIG. 2.

FIG. 3 shows the normal operation of the linear drive 1, i.e. the automatic operation of one exemplary linear motor. Following the branching point Ⓝ, it is checked in a step S11, whether or not the linear drive 1 is in standby operation. Standby operation means that the control circuit maintains the respective sliding door leaf 4 in position. In the simplest case, the associated linear motor(s) is/are not operated and is/are effectively in standby. As an alternative, it is intended that the control circuit controls the linear motor(s) such that it/they apply a holding force of predetermined force, for example in a range of between 3 N and 10N. This relates in particular to a closed position of the sliding door leaf 4, which is thereby maintained closed, or, in case of movement of the sliding door leaf 4 in opening direction, is driven in closing direction with a corresponding driving force. As an alternative, a regulation may be provided such that the linear motor maintains the sliding door leaf 4 in position, consequently, upon a manual movement for example, the latter will be automatically displaced back into the standby position.

If, in step S11, the linear drive is not in standby operation (NO)-branch following step S11), preferably at least three monitoring circuits are activated.

At first a closing edge monitoring is activated (step S12), by means of which it can be determined if an obstacle, such as a finger of an individual is located in an area of a respective closing edge and thus if a risk of a possible pinching and therefore injuring or damaging might be given. The closing edge monitoring may be configured such that respectively only the closing edge is monitored which points into a current travel direction of the sliding door leaf 4. As an alternative, both closing edges, namely the main and secondary closing edges can be simultaneously monitored all the time.

In addition an obstacle detection can be activated (step S13) by means of which it will be determined whether or not an obstacle is located in front of the sliding door leaf 4 during the displacement thereof.

In addition, preferably a movement monitoring is activated (step S14) by which unusual travel conditions can be determined, as will be explained later.

After activating the monitoring systems, it is checked in step S15 if the sliding door leaf 4 is already at the terminal position to which it is to be displaced. If this is the case (YES-branch following step S15), via a branching point, the method returns to step S2 for activating the standby operation of the linear drive. However, if an obstacle is detected, may it be in the closing edge area or generally in the displacement area in front of the sliding door leaf 4, in step S17 a so-called movement-safety reaction will be performed. In the simplest case, this reaction includes stopping the linear motor. In addition, a generative operation of the linear motor may be provided in order to bring the sliding door leaf 4 even faster to a halt. Thereupon, the method returns to step S3 via a branching point Ⓔ in FIG. 1. It is thereby assured that the linear drive 1 is stopped until the obstacle has been removed, and the sliding door leaf 4 continues to be displaced in the desired direction of movement.

As an alternative, reversing the linear motor is provided. In this case, the linear motor is at first, as described in the previous section, brought to a halt, and thereupon displaced, however in an opposite direction, and namely preferably up to a terminal position corresponding to this travel direction. This means, instead of to the branching point Ⓔ, now the control circuit proceeds to step S11.

Figure 4:
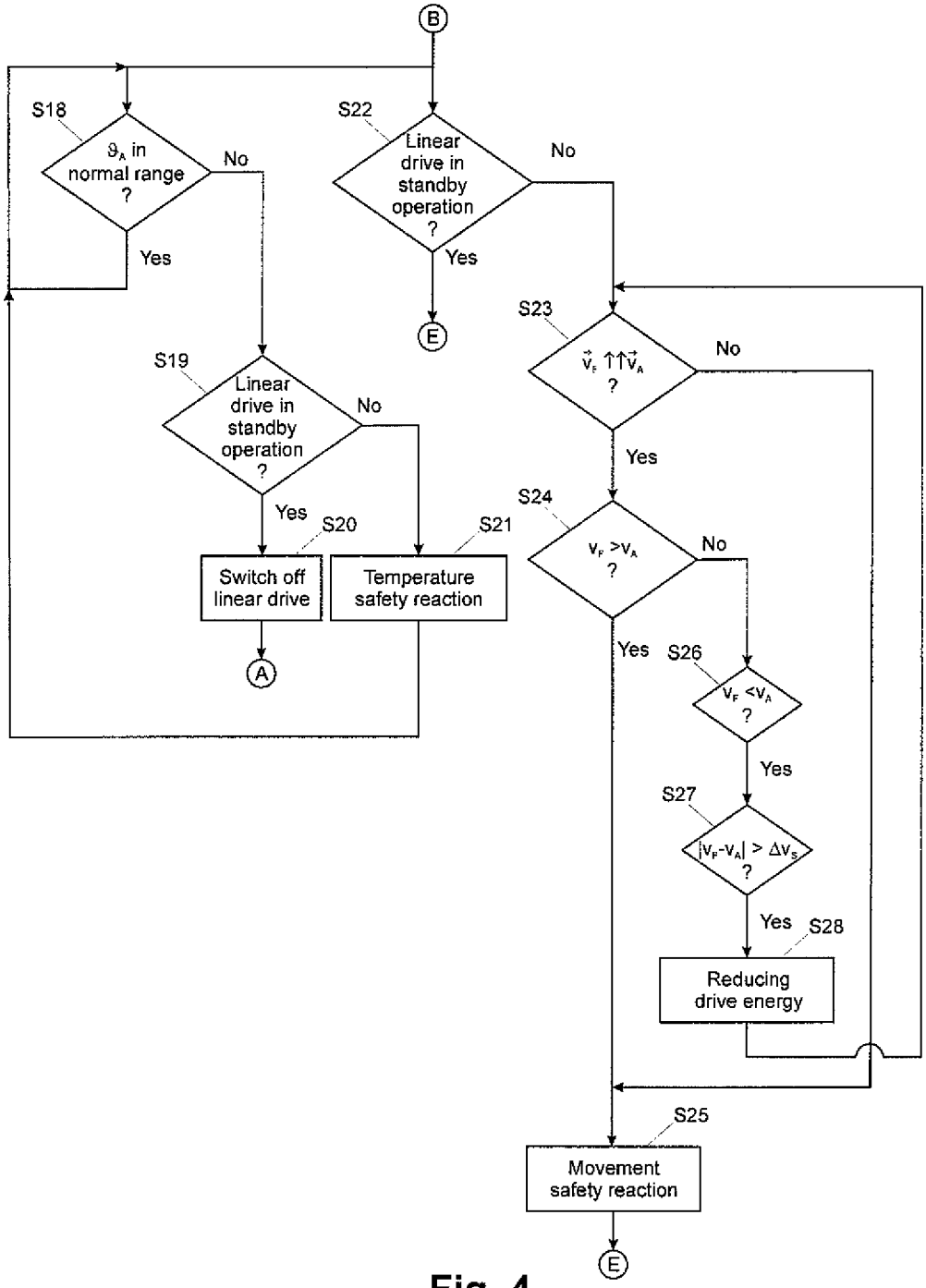
FIG. 4 is a flowchart for monitoring the normal operation of FIG. 3.

The movement monitoring includes mainly a routine shown in FIG. 4, to which the method proceeds via the branching point Ⓑ in FIG. 3. This monitoring routine includes preferably at least two monitoring branches. In a first branch, illustrated on the left side in FIG. 4, a temperature monitoring is performed. In this case, a temperature $\theta_A$ is monitored so that it is comprised within a predetermined normal range. Usually this range is determined by means of a peak temperature for the linear drive 1 which is not to be exceeded. This is checked in a step S18.

Even if only one temperature $\theta_A$ value is indicated, an individual temperature sensor may be provided for each temperature sensitive part of the linear drive 1, such as a power supply unit for the control circuit, and the control circuit itself. This means $\theta_A$ is valid for all temperature values in the linear drive 1 to be monitored. Furthermore, each temperature sensor may be coupled to its own evaluation circuit, which checks a respective temperature value. Outputs of these evaluation circuits may be coupled for example to inputs of an OR-element, which preferably is a component of the control circuit 10. The evaluation circuits are preferably high active, i.e. upon exceeding the respective temperature to be checked, they issue logic "1", otherwise logic "0". If at least one logic "1" is applied to one of the inputs of the OR-element, this signal switches through to the control circuit, which receives this signal as an interruption input signal for example, and is thus able to immediately react. In the event the evaluation circuits are of low activity, i.e. they issue logic "0" if the respective temperature to be checked is exceeded, and otherwise logic "1", instead of the OR-element, a NAND-element is coupled, which issues logic "0", as soon as logic "0" is applied to one of its inputs.

If a temperature excess is determined (NO-branch following step S18), it is checked in a subsequent step S19 whether or not the linear drive 1 is in standby operation. If the linear drive 1 is in standby operation, it is safe to assume that the temperature increase has been caused from the outside, for example by a fire, respectively that the linear drive 1 has such a malfunction that is needs to be shut down (step S20). As an alternative, it may be provided that the control circuit causes the linear motor to open the sliding door leaf 4 in case of an escape door, or to close it with the intention to prevent a spread of a fire, and thereupon to switch off the linear drive 1. Thereupon, the method proceeds via a branching point Ⓐ before step 1 in FIG. 2, in order to allow for restarting the linear drive 1.

If the linear drive 1 is not in standby operation, i.e. the sliding door leaf 4 is being displaced, the control circuit can cause the linear motor to displace the sliding door leaf 4 at a lower speed, in order to promote cooling off of overheated parts of the linear drive 1. Instead, it may be provided in this case to switch off the linear drive 1.

Parallel to the temperature monitoring, the method passes through a second routine branch. It is likewise checked in a step S22, whether or not the linear drive 1 is in standby operation. If the linear drive 1 is in standby operation (YES-branch following step S22), via branching point Ⓔ, the method returns to step S3 in FIG. 2.

If the linear drive 1 is not in standby operation (NO-branch following step S22), the method firstly checks in a step S23, whether or not the sliding door leaf 4 moves into a direction given by the linear drive 1, i.e. whether or not a speed $\vec{v}_A$ of the linear drive 1, respectively of the linear motor thereof and a speed $\vec{v}_F$ of the sliding door leaf 4 correspond with regard to their direction, namely point into the same direction. In case they point into different directions, the sliding door leaf 4 moves opposite to the driving direction of the linear drive 1, this represents a faulty operating behaviour. This may occur if the sliding door leaf 4 is manually displaced opposite the driving direction. Based on this, a so-called movement safety reaction is initiated by the control circuit 10 in step S25. In order to prevent the linear drive 1 from damage, the actuation of the linear motor is switched off and the sliding door leaf 4 can be manually moved or displaced. If the sliding door leaf 4 reaches a predetermined braking area in front of a terminal position of the sliding door leaf 4, in the event of too high travel speed, it is intended to slow down the sliding door leaf 4 for example by a generative operation of the associated linear motor 1 and/or, with regard to a current travel direction, to drive it in an opposite direction. After a deceleration, via the branching point Ⓔ in FIG. 2, the method returns to step S3.

If, in step S23, the sliding door leaf 4 moves in a direction given by the linear drive 1, it is checked in a step S24 whether or not the travel speed $|\vec{v}_F|$ is larger, i.e. in terms of values, than a driving speed $|\vec{v}_A|$ of the linear drive 1. If the speed is higher, the sliding door leaf 4 is accelerated from outside, for example by an individual. In order to prevent the linear drive from damages, again a movement safety reaction (step S25) is performed, as explained above.

If the travel speed $|\vec{v}_F|$, in terms of values, is smaller than or equal to the driving speed $|\vec{v}_A|$ of the linear drive 1, it is checked in a step S26, whether or not the travel speed $|\vec{v}_F|$ of the sliding door leaf 4 is smaller in terms of values than the driving speed $|\vec{v}_A|$ of the linear drive 1. In this case, possible losses, for example on account of friction or of similar energy losses, are included in the driving speed $|\vec{v}_A|$. For this purpose, parameters determined during the learning run can be consulted by the control circuit 10. If the comparison delivers a positive result, i.e. if the travel speed $|\vec{v}_F|$ of the sliding door leaf 4 is smaller in terms of values than the driving speed $|\vec{v}_A|$ of the linear drive 1, it is checked in a subsequent step S27, whether or not the speed difference exceeds a predetermined threshold $\Delta v_S$. If the excess is larger than the given speed difference $\Delta v_S$, it can be assumed that the sliding door leaf is slowed down manually, for example by an individual. To prevent damage, the driving energy of the linear drive 1 is reduced in a subsequent step S28 and is completely switched off in the extreme case. Thereupon, the method returns again to step S23, to check whether or not the reduction of the driving energy is furthermore necessary.

The two branches shown in FIG. 4 are preferably executed in parallel. This may be realized for example by two separately configured circuitries incorporated in the control circuit 10. As an alternative, the two routine branches can be executed in a quasi parallel manner by means of a single micro-controller or processor according to known pipeline methods.

Figure 5:
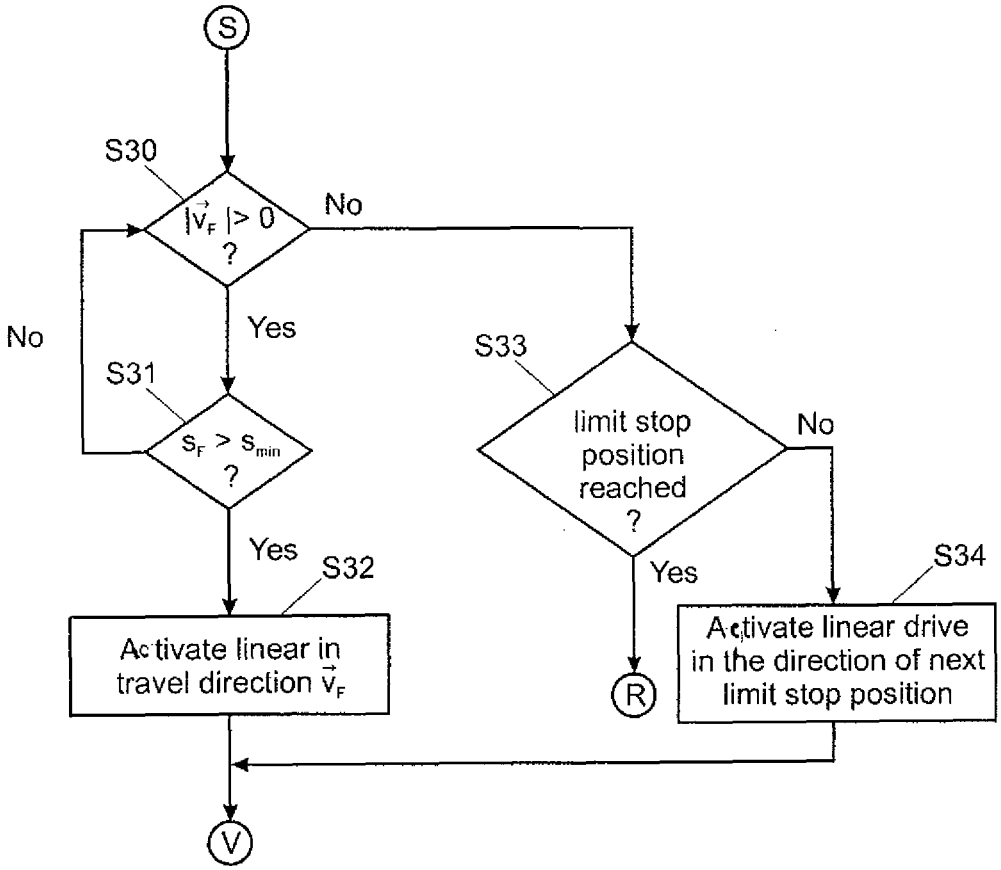
FIG. 5 is a flowchart for activating the linear drive according to an embodiment of the invention.

If the check in step S11 in FIG. 3 reveals that the linear drive 1 is not in standby operation, via a branching point Ⓢ the method proceeds to a routine shown in FIG. 5.

The routine shown in FIG. 5 shows a possibility, according to an embodiment of the invention, to activate the linear drive 1 such that the sliding door leaf 4 is displaced by the linear drive, respectively the linear motor(s) thereof. In a step S30, it is checked whether or not the travel speed $|\vec{v}_F|$ of the sliding door leaf 4 is higher than 0.

If the travel speed $|\vec{v}_F|$ is larger than 0, it is checked in a subsequent step S31, whether or not a travelled path $s_F$ of the sliding door leaf is longer than a predetermined value $s_{min}$, preferably stored in a non-volatile memory of the control circuit 10. Thus, the value $s_{min}$ represents a minimum travel path. If it is equal or smaller, the method returns to step S30. Otherwise, in a following step S32, the linear drive 1 is activated for driving the sliding door leaf 4 in the direction given by the speed vector $|\vec{v}_F|$, i.e. in the current travel direction of the sliding door leaf 4. Following this activation, the method proceeds to step S15 in FIG. 3 via a branching point Ⓥ. Preferably, the minimum travel path $s_{min}$ is fixed to a value between 10 mm and 30 mm.

It is thus possible to effect an opening, and closing of a sliding door leaf 4, in that the sliding door leaf 4 is manually moved in a corresponding travel direction along a given minimum travel path.

Once the travel speed $|\vec{v}_F|$ of the sliding door leaf 4 has been determined in step S30 at a value of 0, i.e. if the sliding door leaf 4 is at a halt, it is checked in a following step S33, whether or not the sliding door leaf 4 is located in a terminal position. If it is located in a terminal position, i.e. an open or closed position, the method proceeds to step S2 in FIG. 2, via the branching point Ⓡ.

Otherwise, the linear drive 1 is activated in step S34, and namely in the direction of the next terminal position. Thereupon, the method proceeds to step S15 in FIG. 3, via the branching point Ⓥ. Thereby, the sliding door leaf 4 can be displaced back into a respective terminal position, for example if it has been manually displaced by less than the minimum path $s_{min}$. Thereby, a subsequent checking with regard to a repeated manual travel can be performed error-free. In addition the sliding door leaf 4 is prevented from being accidentally gradually opened or closed.

Obviously, in addition to the initial manual displacement of the sliding door leaf 4, the activation can be effected by activation switches, incorporated in a wall for example.

As an alternative or in addition, switches are incorporated in the respective sliding door leaf 4 and are preferably formed by touch switches. In an all-glass sliding door leaf, such a switch may be realized as well by piezoelectric elements incorporated in the glass, which are coupled to the control circuit by RFID, for example. When pressing a respective piezoelectric element, a voltage is issued, which causes the switch element to emit an activation command, which is received by the associated control circuit.

Altogether, a linear motor operation allows the sliding door leaf 4 to travel in a harmonic and smooth manner. In addition, a simple, stable regulation under different conditions, such as different sliding door leaf weights is possible. The travel speed $|\vec{v}_F|$ of the sliding door leaf 4 can be very precisely adjusted within a relatively small tolerance range.

To improve the regulation and obstacle detection, the control circuit is adapted to continuously check operating parameters during operation, such as a drive voltage, and if required, to adapt operation parameters.

The control circuit is preferably adapted to operate the respective linear motor in a so-called full-energy mode. Preferably, this mode is only possible by actuating a sealed switch. It is preferred that in this mode, the travel speeds $|\vec{v}_F|$ of the sliding door leaf 4 in both travel directions are preferably continuously variable respectively by a potentiometer. A closing speed of the sliding door leaf 4 is preferably slower than an opening speed of the sliding door leaf 4 and is preferably 0.6 times the amount of the opening speed. It is thus possible to enhance the safety. On account of the relatively slow closing speed, the sliding door leaf can be stopped faster and, if required, it can be reversed.

As an alternative or in addition, the control circuit is adapted to slow down the sliding door leaf 4 displacement shortly prior to reaching a closed position, preferably in an area of between 100 mm and 200 mm in front of it. A travel speed in this area preferably is between 50 mm/s and 100 mm/s, wherein a particularly sensitive obstacle detection is provided. In this case, this is the so-called main closing edge monitoring.

In addition or as an alternative, an emergency stop function is intended, in that an emergency stop switch, respectively switches for separating the linear drive 1 from the energy supply can be provided at the linear drive 1 or provided in the building, for example in a wall.

Again as an alternative, a clamping magnet, which operates according to a closed-current principle and is coupled to the control circuit 10, may be provided at a respective terminal position, which, with sliding doors, usually are terminal positions. The clamping magnet reaches an operative connection preferably with a side of a carriage 2 of the sliding door leaf 4, where the side and the carriage 2 both face the magnet, as soon as the sliding door leaf 4 is located in a closed position. Such a device may be provided as well for the open position of the sliding door leaf 4. Thus, a second clamping magnet reaches an operative connection with a side of a carriage 2, now both facing the magnet, of the sliding door leaf 4. In case of power failure, the clamping magnets are no longer supplied with energy and the sliding door leaf 4 is released.

As an alternative or in addition, the control circuit is adapted to stop the respectively controlled linear motor as fast as possible in the event of a power failure, and thus the driven sliding door leaf 4. It is provided for this purpose, in addition to switch off the linear motor, to operate it as a generator, in coupling it to a so-called braking resistor. This can be realized by a switching element connected according to the closed current principle, such as a relay or a switch-over circuit for example.

In addition or as an alternative, a storage for electrical energy, such as an accumulator or high performance capacitor, is provided, in which energy is stored during a normal operation of the linear drive. In the event of power failure, the energy accumulator is coupled to the linear motor 1, respectively to the control circuit such that the linear motor is driven by the stored energy in a direction which is opposite to the current travel direction of the sliding door leaf 4. This allows for slowing down the sliding door leaf 4 even faster. In addition, it may be provided that the control circuit 10, while utilizing the stored energy, displaces the respective sliding door leaf 4 by the linear motor completely up to a predetermined terminal position.

After having completed one of the above described braking or travel procedures up to the respective terminal position, the control circuit 10 switches off in so far that it does not control the respective linear motor 1 any more. It is thereby achieved that the sliding door leaf 4 continues to be manually operable.

If the control circuit 10 receives sufficient energy, i.e. the power failure is repaired, the control circuit 10 is preferably adapted to perform a previously described positioning run.

As an alternative or in addition, a permanent open function can be activated, in which the sliding door leaf 4 is displaced into an open position by the linear drive 1 and is thereupon commutated to standby operation, without automatically displacing the sliding door leaf 4 into a closed position, for example after an adjustable open time has elapsed.

As an alternative or in addition, a function is provided in which the sliding door leaf 4 is displaced into a respective terminal position and remains there until a new starting impulse, for example by a switch, causes the linear drive 1 to displace the sliding door leaf 4 into the respective other terminal position. In addition, it can be provided that a switching impulse during a displacement of the sliding door leaf 4 by means of the linear drive 1 causes the latter to displace the sliding door leaf 4 into the opposite direction.

Switching over between the individual travelling functions can be done by a program switch. The program switch is preferably disposed at a faceplate of the linear drive 1, i.e. outside, or as an alternative, it is disposed covered by the faceplate. As an alternative or in addition, line ports, such as USB or FireWire can be provided, in order to connect an external device, such as a palm, mobile phone, and/or a computer and to be able to switch(over) the functions. As an alternative or in addition, the linear drive may have, preferably at the control circuit, an interface for wireless communication, such as Bluetooth or infrared.

Even if the invention has been described with regard to a single leaf sliding door system, it is readily applicable to multi-leaf sliding door systems, such as telescopic sliding door systems, as well as to curved sliding doors, circular sliding doors, folding sliding doors, mobile partitioning walls and the like.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A linear drive configured to move at least one panel along a travel path, the linear drive comprising:

at least one linear motor for the at least one panel, comprising:

a stator member;

a carriage; and a rotor member;

a control circuit configured to:

stop the at least one linear motor in the event of failure of an energy supply to the linear motor by switching-off the linear motor and operating the linear motor as a generator, enable displaceability of the at least one panel after stopping, perform a positioning run initially or after activation of the at least one panel to determine at least one limit stop of the at least one panel after the energy supply is applied, perform a learning run of the at least one panel to determine predetermined parameters for driving the at least one panel, the learning run including at least one displacement of the at least one panel in a first travel direction and at least one displacement of the at least one panel in a second direction opposite to the first direction, at a minimum travel speed, the control circuit comprising:

a switch configured to switch off the energy supply of the at least one linear motor; and a microprocessor.

2. The linear drive according to claim 1, further comprising an adjuster configured to adjust a travel speed of the at least one panel.

3. The linear drive according to claim 2, wherein the adjuster is configured to separately adjust travel speeds of the at least one panel for each respective travel direction.

4. The linear drive according to claim 1, wherein the control circuit further configured to at least one of switch off the linear motor and operate the linear motor as a generator during one of:

a displacement of the at least one panel in a direction opposite to the driving direction of the linear motor and at a travel speed, which is different from a driving speed of the linear motor.

5. The linear drive according to claim 1, further comprising an activator configured to activate the linear motor to move the at least one panel in a predetermined travel direction.

6. The linear drive according to claim 5, the linear motor further comprising a displacement sensor, the control circuit is configured to determine a movement and a current position of the at least one panel along the travel path by signals from the displacement sensor, wherein the control circuit, when determining a movement of the at least one panel from its standby condition and a deviation of the current position of the at least one panel from a standby position, in which a start of the movement of the at least one panel by more than a predetermined minimum measure has been detected for a first time, is adapted to activate the linear motor, such that the linear motor continues to move the at least one panel in the movement direction.

7. The linear drive according to claim 6, wherein the determination of the movement and the deviation limited to terminal positions of the at least one panel.

8. The linear drive according to claim 1, wherein the control circuit further comprises a monitor configured to monitor at least one predetermined parameter to detect a presence of an obstacle on the travel path of the at least one panel.

9. The linear drive according to claim 8, wherein the at least one predetermined parameter comprises at least one of:

a travel speed of the at least one panel, a position of the at least one panel, and a drive current of the linear motor.

10. The linear drive according to claim 9, wherein the control circuit is further configured to allow for a displacement of the at least one panel independently from the linear motor up to a predetermined maximum travel speed, and, when the predetermined maximum travel speed is exceeded, the linear motor is operated in a direction opposite to a current travel direction of the at least one panel at a driving force based at least in part on how much the maximum travel speed is exceeded.

11. The linear drive according to claim 10, wherein operating the linear motor when the predetermined maximum travel speed is exceeded comprises at least one of:

switching-off the linear motor;

operating the linear motor as a generator; and driving the linear motor in a direction opposite to the current travel direction of the at least one panel.

12. The linear drive according to claim 1, wherein the control circuit is further configured to drive the linear motor according to a predetermined braking behavior, when the at least one panel reaches a predetermined braking area.

13. The linear drive according to claim 12, wherein two braking areas are provided respectively in front of a limit stop of the at least one panel.

14. The linear drive according to claim 1, wherein the control circuit is further configured to control the linear motor in at least one terminal position of the at least one panel such that the at least one panel is prevented from moving from the respective terminal position by a predetermined force.

15. The linear drive according to claim 1, wherein the control circuit is further configured to control the linear motor such that the at least one panel maintains its position in at least one terminal position of the at least one panel.

16. The linear drive according to claim 1, further comprising a sensor system for monitoring operating parameters of the linear drive.

17. The linear drive according to claim 16, wherein the operating parameters comprise an operating temperature at least one of the linear motor, the control circuit, and a power supply unit of the linear drive.

18. The linear drive according to claim 17, wherein the control circuit is configured to vary the control of the linear drive when at least one of the operating parameters is outside an admissible range.

19. The linear drive according to claim 18, wherein the varied controlling comprises at least one of reducing a driving speed of the linear motor, extending an opening or closing holding time with regard to the at least one panel and switching-off the linear drive.

20. The linear drive according to claim 1, wherein the at least one panel is one of a curved sliding door leaf, a circular sliding door leaf, a folding door leaf, and a mobile partitioning wall module.

21. An installation comprising a plurality of panels moveable along a travel path, each of the panels comprising a linear drive, wherein the linear drive comprises:

at least one linear motor for the at least one panel, comprising:

a stator member;

a carriage; and a rotor member;

a control circuit configured to:

stop the at least one linear motor in the event of failure of an energy supply to the linear motor by switching-off the linear motor and operating the linear motor as a generator, enable displaceability of the at least one panel after stopping, perform a positioning run initially or after activation of the at least one panel to determine at least one limit stop of the at least one panel after the energy supply is applied, perform a learning run of the at least one panel to determine predetermined parameters for driving the at least one panel, the learning run including at least one displacement of the at least one panel in a first travel direction and at least one displacement of the at least one panel in a second direction opposite to the first direction, at a minimum travel speed, the control circuit comprising:

a switch configured to switch off the energy supply of the at least one linear motor; and a microprocessor.

* * * * *